United States Patent [19]

Pendry

[11] Patent Number: 5,036,748

[45] Date of Patent: Aug. 6, 1991

[54] WEAPON SYSTEM

[75] Inventor: Richard A. Pendry, Guildford, England

[73] Assignee: The Marconi Company Limited, England

[21] Appl. No.: 568,236

[22] Filed: Aug. 15, 1990

Related U.S. Application Data

[63] Continuation of Ser. No. 380,872, Jul. 17, 1989, abandoned.

[30] Foreign Application Priority Data

Jul. 20, 1988 [GB] United Kingdom ..... 8817274

[51] Int. Cl.[5] ..... F41G 3/06

[52] U.S. Cl. ..... 89/36.13; 89/41.07; 89/41.22; 342/67

[58] Field of Search ..... 89/28.2, 36.08, 36.13, 89/36.16, 37.02, 40.03, 41.07, 41.22; 342/67, 107, 119

[56] References Cited

U.S. PATENT DOCUMENTS 4,901,084 2/1990 Huguenin et al. ..... 342/107

*Primary Examiner*—Stephen C. Bentley

*Attorney, Agent, or Firm*—Kirschstein, Ottinger, Israel & Schiffmiller

[57] ABSTRACT

A weapon system particularly for an armored vehicle and comprising a main gun turret (3) for use against tanks and other land-based targets, a secondary turret (1) mounted on the main gun turret (3) and carrying one or more rapid-fire machine guns (9), and a millimetric surveillance and tracking radar mounted on the secondary turret, the radar being adapted to control the secondary turret (1) and machine gun (9) to aim and fire directly at an on-coming missile at close range preferably to destroy the missile or damage it to such an extent that any impact does not cause substantial penetration of the vehicle.

9 Claims, 3 Drawing Sheets

WEAPON SYSTEM

This is a continuation of application Ser. No. 07/380,872 filed Jul. 17, 1989, now abandoned.

BACKGROUND OF THE INVENTION

1. Field of the Invention

This invention relates to a defensive weapon system for use on a target platform which is vulnerable to attack by missiles of various kinds. The target platform may be an armored vehicle, for example a tank, or a stationary installation such as a bunker.

DESCRIPTION OF RELATED ART

In modern warfare tanks are vulnerable to attack by anti-tank missiles, terminally guided sub-munitions (TGSM), mortar rounds and shells, in addition to standard ballistic 'dumb' weapons. Current anti-ballistic missile systems are very large and ineffective against small guided (and unguided) weapons.

Defensive weapon systems mounted on armored vehicles have hitherto generally been concerned with area defense, for example, of mobile combat forces against attack by aircraft. The armaments proposed in these schemes have generally been missile launchers or automatic guns capable of firing medium-caliber (35 mm, say) high explosive projectiles. Such armaments are intended for engagement at long range, in the order of several kilometers, with targets, such as aircraft, which have considerable crossing velocities. Radar systems for controlling these armaments, therefore, are required not only to search and track the target, but also to predict the point of engagement based on complex computations involving target velocity, projectile ballistics, weather conditions, etc. UK Patent No. 1,108,072 describes an anti-aircraft weapon system of this type mounted on the main turret of a caterpillar vehicle and having a fire control computer to predict the point of engagement of fired projectiles with the target aircraft. The prediction process is further complicated by the need for the radar to make allowance for undefined motion of the vehicle on which the system is mounted, this motion resulting from rotation of the turret and movement due to the elevation and firing of the weapon. The mounting of the radar remote from the weapon further necessitates accurate coordinate transformations to correct for the different view angles of the target. European Patent publication No. 111,192 is similarly concerned with a radar-controlled gun, having a weapon control generator which is supplied with data about the target trajectory, wind velocity, barometric pressure, etc., from which data is predicted the optimum aiming point for the gun. UK Patent No. 1,220,533 describes an anti-aircraft armament, mounted on the turret of an armored vehicle, comprising a pair of automatic medium-caliber anti-aircraft guns, a scanning radar and a target tracking radar. The system features a ballistic computer for the automatic computation of the aiming point for the guns in dependence on the target locating data continuously supplied by the tracking radar.

It will be appreciated that in the weapon systems described in these patent publications the nature of the target, in particular its significant crossing velocity, and the need to achieve engagement at long range to meet the objective of providing area defense, necessitates prediction of both the target and projectile motion so that the weapon can be pointed in the direction most likely to result in a successful engagement.

Defense systems such as described above are, however, both ineffective and inefficient against point attack weapons such as small homing missiles directed toward the target platform, for example the tank. Such a missile can be very small, less than one meter long say, and very fast. Consequently a tracking radar and weapon control system which expects to allow for flight time, weapon trajectory and various other factors becomes ineffective and indeed irrelevant when the attacking missile is within, say, 500 meters range and heading directly for the target platform.

SUMMARY OF THE INVENTION

It is an object of the present invention therefore to provide a point-defense weapon system for a target platform which is effective at short range against weapons of the above kind.

According to the present invention a weapon system for an armored vehicle comprises a main gun turret for use against tanks and other land-based targets, a secondary turret mounted on the main gun turret and carrying one or more rapid-fire machine guns, and a millimetric surveillance and tracking radar mounted on the secondary turret, the radar being adapted to control the secondary turret and the or each machine gun to aim and fire along the line of sight directly at an on-coming missile within a predetermined range.

The radar is preferably adapted to acquire the missile within a range of approximately 1000 meters and to fire at the missile within a range of approximately 500 meters.

Preferably there are two machine guns symmetrically disposed about an azimuth steering axis.

The radar may comprise an antenna having a deployed condition and a stowed condition, the antenna being enclosed within an armored housing in the stowed condition, the housing having an openable armored cover member, and the antenna having a reflector adapted to pivot out of the housing in the deployed condition.

According to another aspect of the present invention a weapon system for defense of a target platform comprises a weapon having an effective range of 1000 meters, a millimetric surveillance and tracking radar, means for discounting targets having a crossing velocity substantially greater than zero, and means for controlling the weapon in response to said radar to fire along the line of sight.

The weapon may comprise at least one rapid-fire machine gun.

BRIEF DESCRIPTION OF THE DRAWINGS

A weapon system for an armored vehicle in accordance with the invention will now be described, by way of example only, with reference to the accompanying drawings, of which.

DETAILED DESCRIPTION OF THE PREFERRED EMBODIMENT

Figure 1:
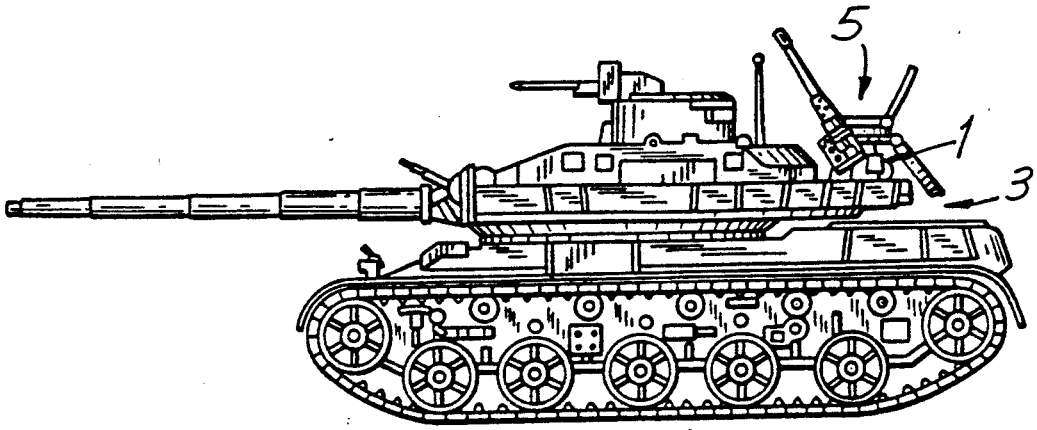
FIG. 1 is an elevation of a main battle tank showing an auxiliary machine gun system fitted to the turret.

Referring to the drawings, FIG. 1 shows the secondary turret 1 mounted on the main turret 3 of a battle tank. A standard mounting ring with power supply and operation interlocks are provided at the vehicle interface.

Figure 3:
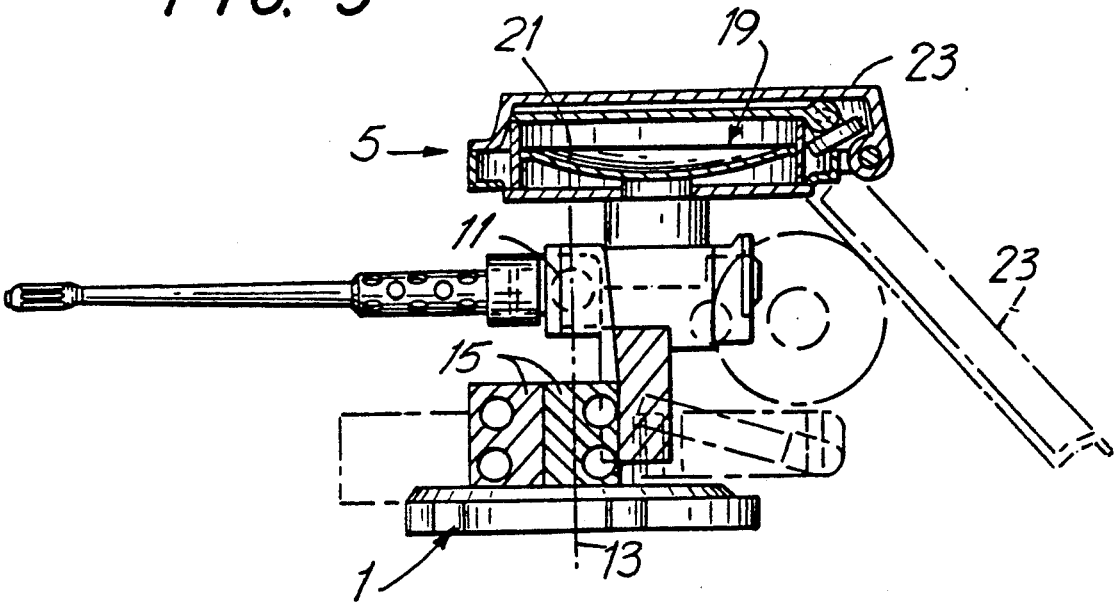
FIG. 3 is a side elevation, partly in section of the auxiliary system.
Figure 2:
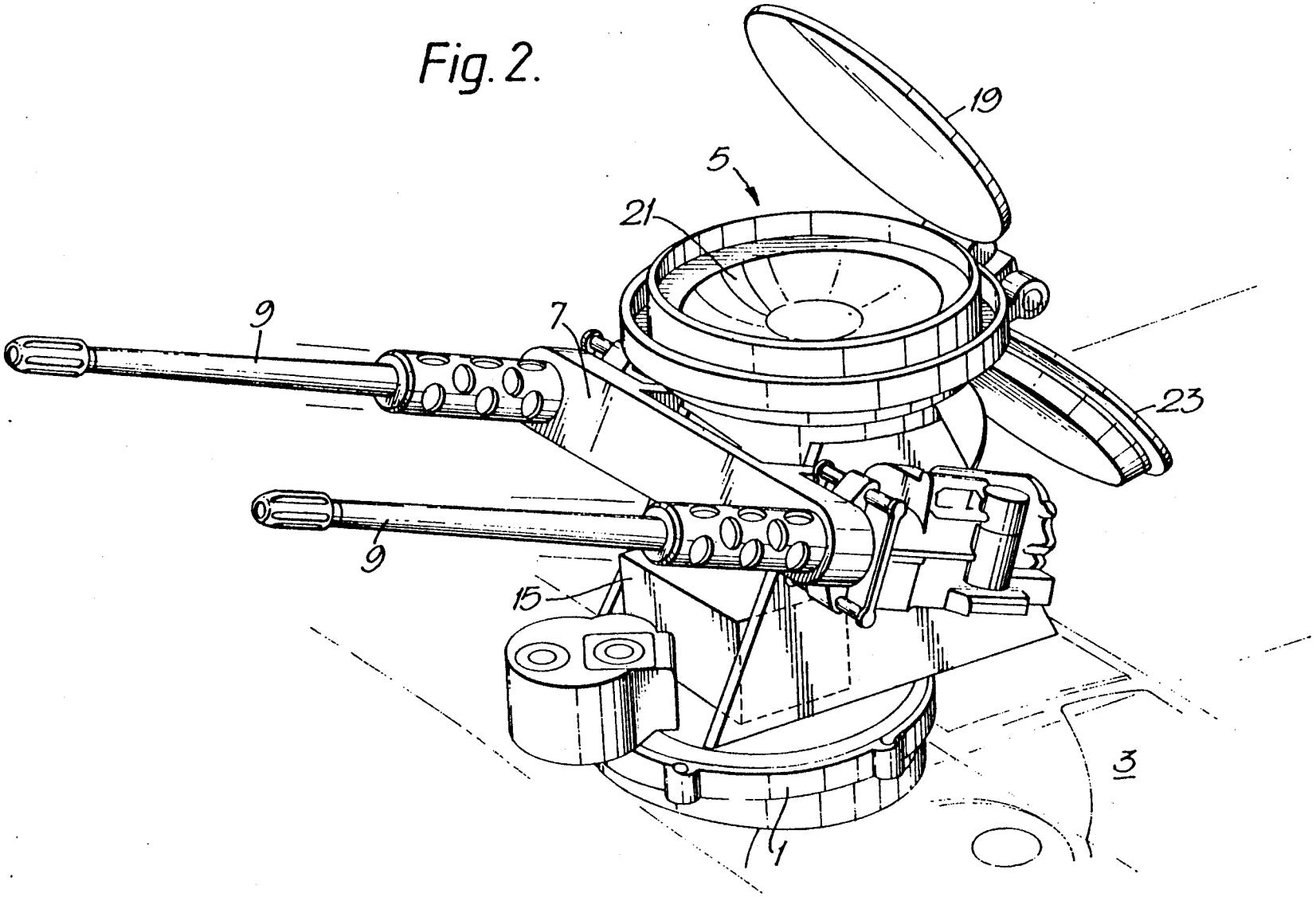
FIG. 2 is a perspective view of the auxiliary system.

The turret 1 incorporates a machine gun mounting and an armored housing 5 for a radar system, shown in greater detail in FIGS. 2 and 3. There are two machine guns 9 coupled by a yoke 7 and pivoted on a horizontal axis 11 for elevation adjustment. Azimuth adjustment is provided by rotation of the turret 1 about a vertical, azimuth, axis 13. The guns are relatively short, less than one meter, and are symmetrically disposed about the vertical axis to reduce the inertia on acquiring a target in azimuth. They are of relatively small caliber, 7.62 millimeter, and have a rapid fire rate, of 570 rounds per minute. While these are preferred values and are found in a standard gun, calibers up to 12.7 millimeter and possibly 25 millimeter, could be employed, together with fire rates in excess of, say, 400 rounds per minute.

Since the object is to hit small missile targets at close range, say inside 1000 meters, the guns are harmonized, converging to a point at a range of 500 meters from a barrel spacing of about 500 millimeters.

The guns are externally powered and the control boxes 15 are positioned under the yoke 7.

200 rounds of ammunition are stored below each gun giving a facility for five 4-second engagements with a combined fire rate approaching 1200 rounds per minute.

The guns are controlled in azimuth and elevation by a millimetric radar system 30 housed in the armored housing 5. This system is a dual frequency (35 GHz/94 GHz) armored flat-pack system. The radar antenna is a lightweight, plastic flat plate reflector 19 which can be elevated as shown in FIG. 2. A reflector dish 21 is mounted within the housing 5 which protects all the sensitive electronics. An armored cover plate 23 is shown swung back for operation in FIG. 2, and in both positions in FIG. 3.

Figure 4:
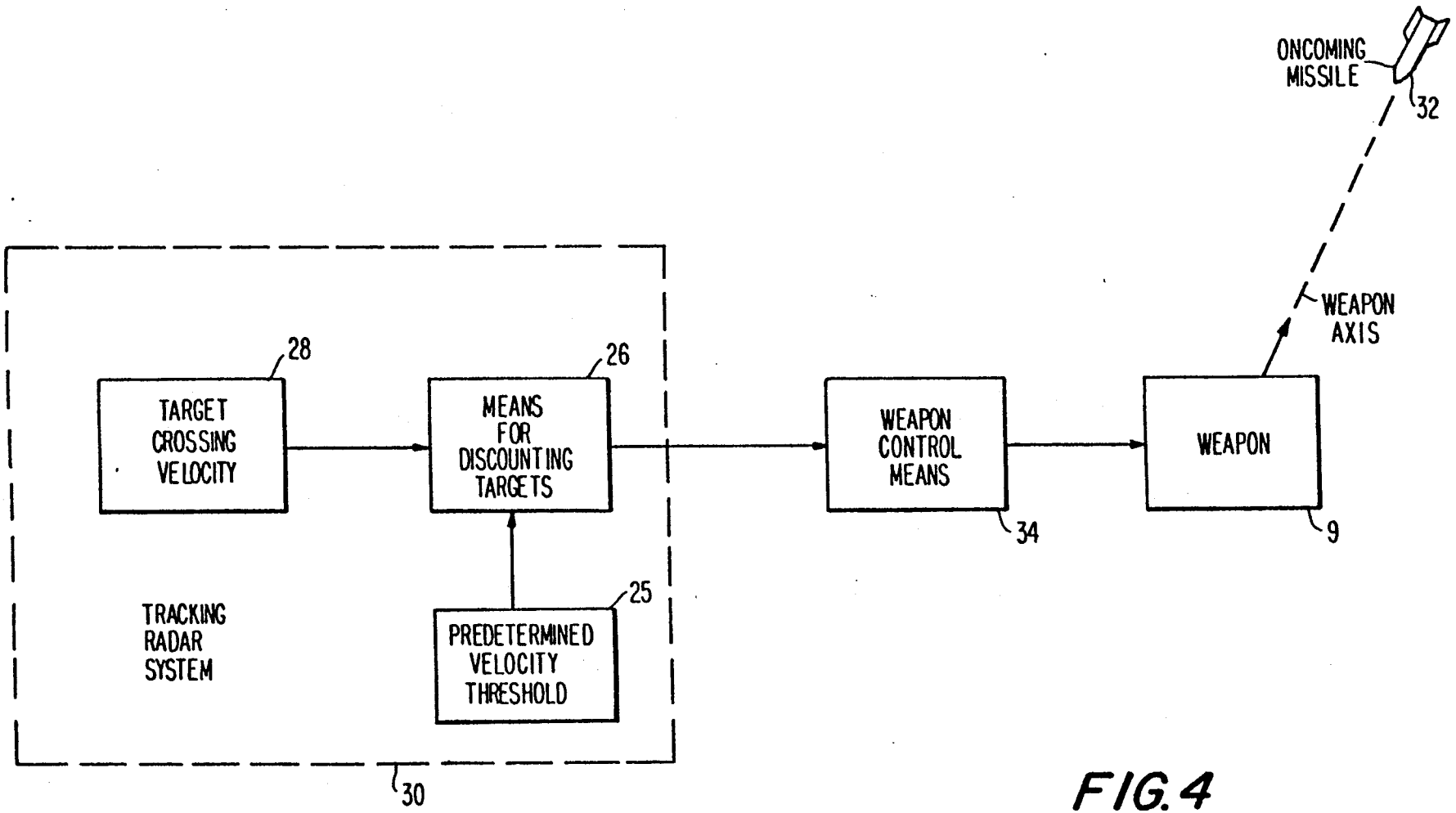
FIG. 4 is a block diagram of a weapon system according to this invention.

The radar 30 is required to detect the specified target types mentioned in the threat, and provide angle, range and velocity data. Targets with any significant crossing velocity, i.e. angular velocity determined at block 28 (see FIG. 4) with respect to the tank, are discounted at blocks 26 and 25. The radar system also has to provide fire control data to the control means 34 for the determination of optimum intercept range for the selected target.

The radar is sufficiently accurate to acquire a missile target in a surveillance mode at 35 GHz within a range of approximately 1000 meters and to guide the guns in a tracking mode at 94 GHz to fire repeatedly at the target within a range of approximately 500 meters to less than 100 meters. The last round of firing may be timed to impact at only 30 meters from the tank. In this way a target missile is hit at sufficient range that the defended tank is able to withstand the residue of a successful engagement. In order to achieve this the guns are controlled directly by the radar, which not only tracks each shot but also repeatedly corrects its aim. The system does not attempt to destroy the target missile at long range or at any significant crossing speed (either of which would require complex processing for lead angle calculation and which would inevitably seriously reduce the kill probability), but protects only the relatively small area of the tank hull by firing directly at an oncoming guided missile with the aim of at least degrading its homing device to the extent that the missile 32 either misses the tank altogether or hits it at an ineffective angle or in fragments. If the oncoming missile is unguided, ideally it would be sufficiently damaged that the impact of any fragments did not cause penetration of the tank's armor plate. Since the system is concerned only with a short-range attacking missile that is likely to hit the defended tank, the guns need only be pointed directly at the oncoming missile i.e. aimed along the line of sight. Thus there is no requirement for the radar to predict by complex computations the likely engagement point, and the small caliber secondary turret and rapid-fire guns are able to respond quickly to fire at a target soon after its acquisition by the radar. The combination of the millimetric tracking radar and rapid-fire machine guns provides, therefore, an anti-missile point-defense system.

The radar must be active during times of tension but operate in as covert a manner as possible to prevent the transmission acting as a beacon to attract and direct an attack. This is achieved by the use of millimeter wavelengths with their inherent high atmospheric loss, dual frequency, narrow beamwidths, complex waveforms and search strategies to provide a low probability of intercept or detection.

In operation the cover plate 23 is swung open, the flat plate reflector 19 is elevated, and the complete reflector assembly is then rotated to provide the surveillance/acquisition function. Acquisition coverage provides an azimuth range of 360°, a depression angle of 5° and an elevation angle of 70°.

The maximum tracking range is determined by the maximum intercept range, which is less than 1000 m. Reaction time is of the order of 0.5 seconds including intercept prediction calculations. During this time target identification and prioritization are completed in parallel.

In tracking, the radar beamwidth is approximately 0.5 degrees, i.e. very much narrower than for the surveillance function. It will be appreciated that the system is not limited to use on an armored vehicle. It may, for example, be mounted on 'hardened' aircraft shelters and bunkers to provide airfield point-defense. In all cases however, the system provides short-range, point-defense for hardened or armored targets using a line-of-sight weapon.

I claim:

1. A weapon system for point defense of a platform against oncoming missile targets, the system comprising:

(a) a lightweight weapon mounted on said platform, said lightweight weapon being steerable about an azimuth steering axis and an elevation steering axis; and (b) a millimetric surveillance and tracking radar system mounted on said platform for acquiring and tracking missile targets within a range of 1000 meters and for determining a line-of-sight to an acquired missile target, said radar system including:

(i) means for discounting any acquired missile target having a crossing velocity relative to said platform which is substantially greater than zero, and (ii) means for controlling said lightweight weapon for firing along said line-of-sight at an acquired missile target not so discounted.

2. A weapon system according to claim 1, wherein said lightweight weapon comprises two rapid-fire machine guns disposed symmetrically about said azimuth steering axis.

3. A weapon system according to claim 1, wherein said platform comprises an armored vehicle.

4. A weapon system according to claim 1, wherein said radar system includes an antenna assembly comprising a housing and a reflector, said housing having an openable armored cover member and said reflector being pivoted in said housing, said antenna assembly having a stowed condition in which said reflector is protectively enclosed within said housing by said armored cover member, and a deployed condition in which said armored cover member is opened and said reflector is swung out of said housing.

5. A weapon system for point defense of an armored vehicle against oncoming missile targets, the system comprising:

(a) a primary turret mounted on said armored vehicle;

(b) a secondary turret mounted on said primary turret, said secondary turret being steerable about an azimuth steering axis;

(c) a lightweight weapon mounted on said secondary turret, said lightweight weapon being steerable about an elevation steering axis; and (d) a millimetric surveillance and tracking radar system mounted on said secondary turret for acquiring and tracking missile targets within a range of 1000 meters and for determining a line-of-sight to an acquired missile target, said radar system including:

(i) means for discounting any acquired missile target having a crossing velocity relative to said armored vehicle which is substantially greater than zero, and (ii) means for controlling said lightweight weapon for firing along said line-of-sight at an acquired missile target not so discounted.

6. A weapon system according to claim 5, wherein said lightweight weapon comprises two rapid-fire machine guns disposed symmetrically about said azimuth steering axis.

7. A weapon system according to claim 5, wherein said radar system includes an antenna assembly comprising a housing and a reflector, said housing having an openable armored cover member and said reflector being pivoted in said housing, said antenna assembly having a stowed condition in which said reflector is protectively enclosed within said housing by said armored cover member, and a deployed condition in which said armored cover member is opened and said reflector is swung out of said housing.

8. A weapon system according to claim 7, wherein said antenna assembly further comprises a reflector dish permanently mounted in said housing for protecting the radar system means when the antenna assembly is in said deployed condition.

9. A weapon system for defense of a target platform against oncoming missile targets, said weapon system comprising:

(a) a weapon mounted on said target platform, said weapon being steerable about an azimuth axis and an elevation axis;

(b) a millimetric surveillance and tracking radar for acquiring and tracking missile targets within a predetermined range and determining a line-of-sight to an acquired missile target;

(c) a millimetric surveillance and tracking radar comprising means for discounting any acquired missile target having a crossing velocity relative to said target platform which is substantially greater than zero, and means for controlling said weapon in response to said radar for firing along said line-of-sight and within said predetermined range at a missile target not so discounted; and (d) said radar further comprising an antenna having a housing and a reflector, said housing having an openable armored cover member and said reflector being pivoted in said housing, said antenna having a stowed condition in which said reflector is protectively enclosed within said housing by said member, and a deployed condition in which said member is opened and said reflector is swung out of said housing.

* * * * *